US005088901A

United States Patent [19]

Bräuer

[11] Patent Number: 5,088,901

[45] Date of Patent: Feb. 18, 1992

[54] MEMBRANE PUMP WITH A FREELY OSCILLATING METAL MEMBRANE

[75] Inventor: Rüdiger Bräuer, Hamburg, Fed. Rep. of Germany

[73] Assignee: Bran & Luebbe GmbH, Norderstedt, Fed. Rep. of Germany

[21] Appl. No.: 492,593

[22] Filed: Mar. 12, 1990

[30] Foreign Application Priority Data

Mar. 10, 1989 [DE] Fed. Rep. of Germany ..... 3907753

[51] Int. Cl.[5] ..... F04B 9/10; F04B 38/02

[52] U.S. Cl. ..... 417/386; 417/395

[58] Field of Search ..... 417/386, 395, 413; 251/244

[56] References Cited

U.S. PATENT DOCUMENTS

| | | | |
|---|---|---|---|
| 2,920,637 | 1/1960 | Adams | 251/244 X |
| 3,093,086 | 6/1963 | Altoz et al. | 417/395 X |
| 4,372,208 | 2/1983 | Legardinier | 417/395 X |
| 4,465,438 | 8/1984 | Bräuer | 417/386 |

OTHER PUBLICATIONS

Bran & Lubbe brochure, Jan. 1984.

R. Bräuer: "Leckfreie Oszillierende Dosier Pumpen", e. V. Essen, 81, Jahrgang, Heft 3, Nov.-Dec. 1988, pp. 548-561.

*Primary Examiner*—Stephen M. Hepperle

*Attorney, Agent, or Firm*—Michael J. Striker

[57] ABSTRACT

The piston membrane pump has a feed chamber for the fluid to be pumped and a piston working chamber, a membrane hermetically separating the feed chamber and the piston working chamber and a piston oscillating back and forth in the piston working chamber. The piston working chamber is completely filled with a hydraulic medium from a supply container in operation so that the membrane oscillates with the piston. A refill valve which connects the piston working chamber with the supply container cooperates with a spring-loaded sliding control element and a moving force-transmitting element displaceable against it so as to open the valve. So that the pump can operate at higher pressures and temperatures a metal membrane is used, the force-transmitting element is a resilient platelike piece acting against the spring-loaded sliding control element and the membrane has no contact surfaces in the feed chamber on its feed chamber side.

21 Claims, 2 Drawing Sheets

FIG. 1
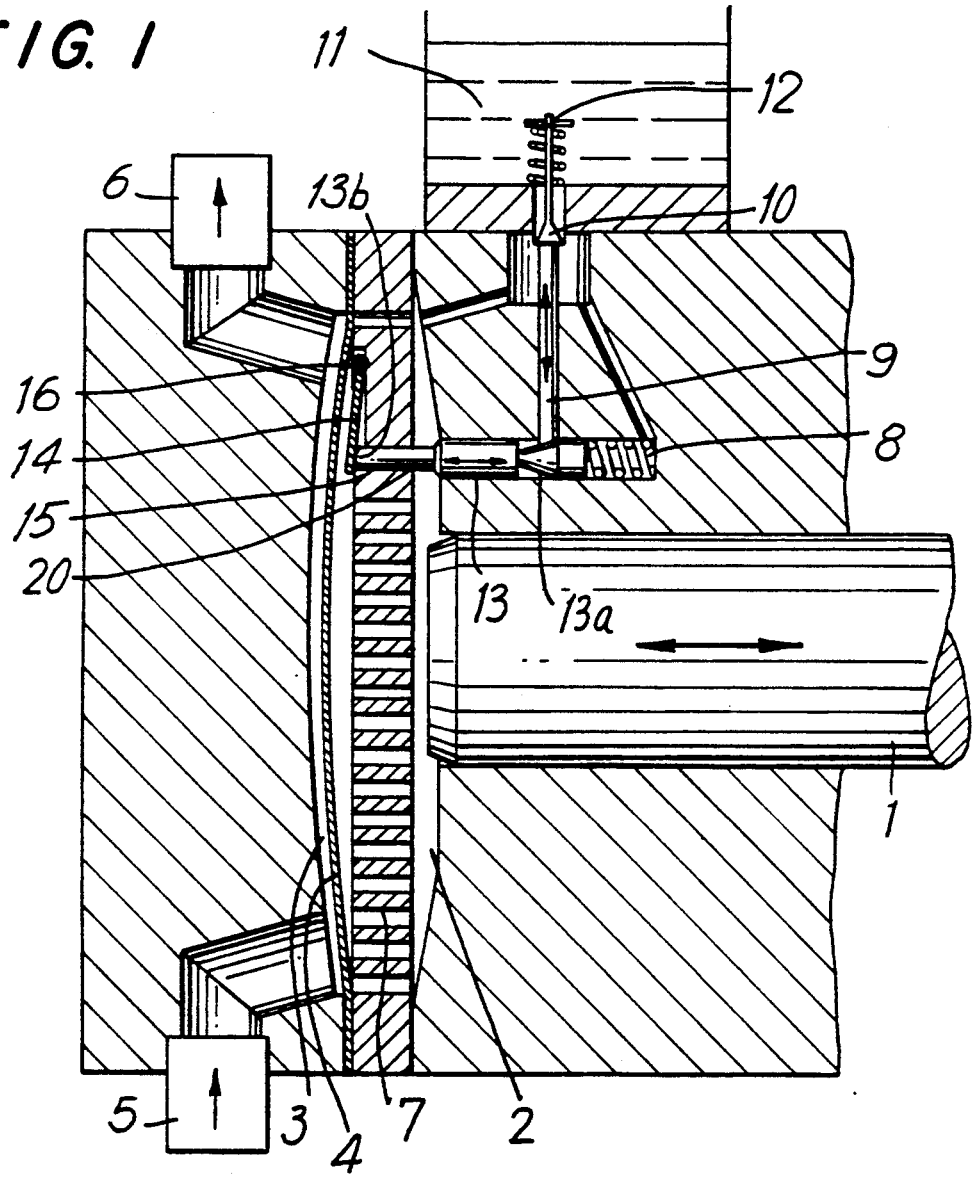
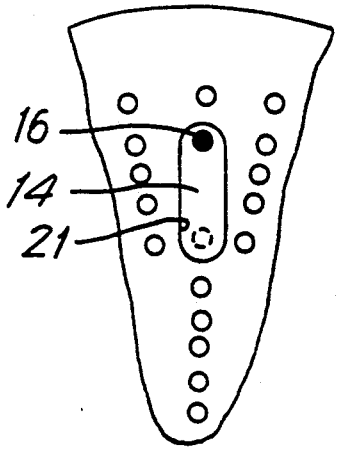
FIG. 2
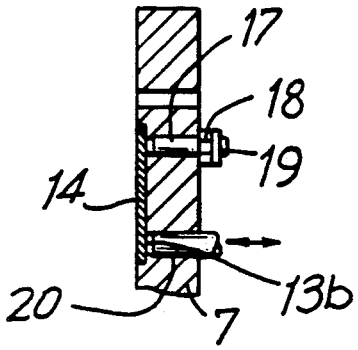
FIG. 3

MEMBRANE PUMP WITH A FREELY OSCILLATING METAL MEMBRANE

BACKGROUND OF THE INVENTION

Our invention relates to a piston membrane pump.

A piston membrane pump is known comprising a piston and a membrane hermetically separating a feed chamber and a piston working chamber. The membrane is operated by the piston which oscillates back and forth in the piston working chamber, which is completely filled by a hydraulic medium. The piston membrane pump is also provided with a supply container for the hydraulic medium, which is connected to the piston working chamber by a refill valve. A moveable force-transmitting element is displacable against the force of a spring toward the end of a piston stroke producing a lowered pressure in the membrane working chamber. Displacement of the moveable force-transmitting element against the spring causes the opening of the refill valve.

This known piston membrane pump is also described in a technical report, "Controlled Membrane Pump for Large Throughput" of the applicant.

This type of piston membrane pump has heretofor been reliably operated for extended periods only when the membrane is made of plastic.

Plastic membranes have about an order of magnitude higher elasticity than steel membranes. Attempts up to now to make membrane pumps with freely oscillating steel membranes have failed, since steel membranes succumb to the load after a short time at their clamped portions or other locations. The Author, Vetter, of the Reference work "Pump", Vulkan-Press, Essen, 1987, p. 346, lower right column, reports that the use of metal membranes in freely oscillating membrane pump structures would never succeed.

For membrane pumps using freely oscillating plastic membranes one is limited to special application situations, pressures and mediums so that the plastic membrane can withstand the operating conditions.

In the membrane pumps known up to now with metal membranes the membrane works between cuplike curved, partially planar perforated bearing surfaces, which define the working chamber.

The perforated contacting surfaces of the described system lead to a series of disadvantages:

The metering of suspensions or contaminated media is not readily possible. Solid material clogs the clamped edge region between the membrane and the perforated plate and penetrates the membrane Also the membrane bears on the central portion of the perforated plate on overfilling of the hydraulic system produced by too low a draw pressure, for example with too long narrow low pressure lines, too high filtration or valve resistance, and with plugged members in the low pressure line.

The perforated plates are complicated to cast or mold and are an expensive component.

The perforated plates produce disadvantageous pressure losses so that viscous media can be fed only with the provided supply pressure.

On overfilling the membrane is pressed into the front perforated plate. Because the molding or casting of this plate results in a plate which does not exactly fit the form of the freely oscillating membrane, the membrane is deformed unsatisfactorily, which leads to a lifetime which has been shortened disadvantageously.

Finally, the principle of the double membrane pump is known, in which two membranes are separated from each other by a fluid filled chamber. The hydraulic-side membrane operates between cup-like boundary surfaces and takes control of the medium-side membrane, which has cuplike contacting surfaces only on the fluid filled chamber side, the medium side being free of them. The filled intermediate space provides however an additional dead space. The filling is expensive and the maintenance of an exactly filled volume is problematical.

SUMMARY OF THE INVENTION

It is an object of the invention to provide a membrane pump which can feed a medium at higher pressures and temperatures than the currently known membrane pumps.

This object and others which will be made more apparent hereinafter are attained in a piston membrane pump having a feed chamber and a piston working chamber, comprising a membrane hermetically separating the feed chamber and the piston working chamber, a piston oscillating back and forth in the piston working chamber, the piston working chamber being completely fillable with a hydraulic medium, a supply container for the hydraulic medium, a refill valve which connects the piston working chamber with the supply container, a spring-loaded sliding control element and a moving force-transmitting element, which is displacable by the spring-loaded sliding control element resulting in opening of the refill valve.

In the improved membrane pump according to our invention a) the membrane is made of metal, b) the force-transmitting element comprises a resilient plate-like piece opposing the action of the control spring of the sliding control element, and c) the feed chamber contains no contact surfaces for the membrane.

Because a metal membrane is used the pump according to our invention can compress the fed medium to higher pressure. The maximum operating temperatures may far exceed 150° C. Also pressures of for example 3,500 bar are attainable with the structure according to our invention.

Since the sliding control element for the refill valve is acted on both ends by springs or spring like devices it can follow the motion of the membrane particularly exactly. Surprisingly this is enough to guarantee an exact refilling of the piston chamber with hydraulic media with the displacement of the metal membrane reduced by an order of magnitude relative to the plastic membrane. The advantageously reduced positioning force of the control element leads to a reduced load on the metal membrane so that the occurring loads can be successfully carried over a longer time interval.

Since there is no contact surface for the membrane in the feed chamber, contaminated or dirty feed media can be pumped without the membrane being destroyed.

The platelike structure of the force-transferring element reduces further advantageously the surface pressure on the membrane on operation of the refill valve so that a lengthened lifetime for the pump membrane results.

A perforated plate arranged in the piston working chamber prevents the overloading of the membrane during impermissible operating conditions.

Inexact or erroneous action during operation of the refill valve is avoided because the force-transmitting element and the control element cooperates under the action of the applied forces.

It is particularly advantageous that a structure results, in which the force-transmitting element comprises a clamped leaf spring. Such a structure has an advantageously reduced mass so that on operation the operating forces on the refill valve are only slightly increased by the weight of the components.

When the leaf spring is directed radially toward the center of the membrane from its clamped position, it is particularly advantageous when it is curved so that its curvature coincides with the curvature of the membrane. The mechanical load on the membrane is advantageously further reduced on operation of the refill valve because of that.

A detachable clamping of the force-transmitting element of the invention has the advantage that different clamping forces can be attained according to the operating conditions so that also after they are made, subsequently, the membrane pump may be adjusted to changed operating conditions.

For further reduction of the membrane load it is advantageous to fit the curvature of the leaf spring to that of the membrane. This can occur in different ways. The professional can provide the adjustment of the leaf spring by suitable selection of its clamping force, its shape and also its position relative to the membrane center so that an especially good fit of the leaf spring to the membrane results.

Additional advantageous features of our invention appear in the dependent claims appended below.

When the perforated supporting plate is provide on the hydraulic media side rigidly clamped in place and the metallic leaf spring inserted flush in this plate, the leaf spring can be pivoted in the direction of the feed chamber with the membrane freely oscillating. On refilling with hydraulic oil as needed it pushes against a comparatively weak spring force, whereby the actuator rod of the refill valve is released and a connection between the supply container and the hydraulic chamber is made.

BRIEF DESCRIPTION OF THE DRAWING

The objects, features and advantages of the present invention will now be illustrated in more detail by the following detailed description, reference being made to the accompanying drawing in which:

FIG. 1 is a schematic longitudinal cross sectional view through a piston membrane pump according to our invention, FIG. 2 is a plan view of a force-transmitting element in the supporting plate of the piston membrane pump of FIG. 1, FIG. 3 is a cross sectional view through another embodiment of the force-transmitting element mounted on the supporting plate.

DETAILED DESCRIPTION OF THE INVENTION

Figure 4A:
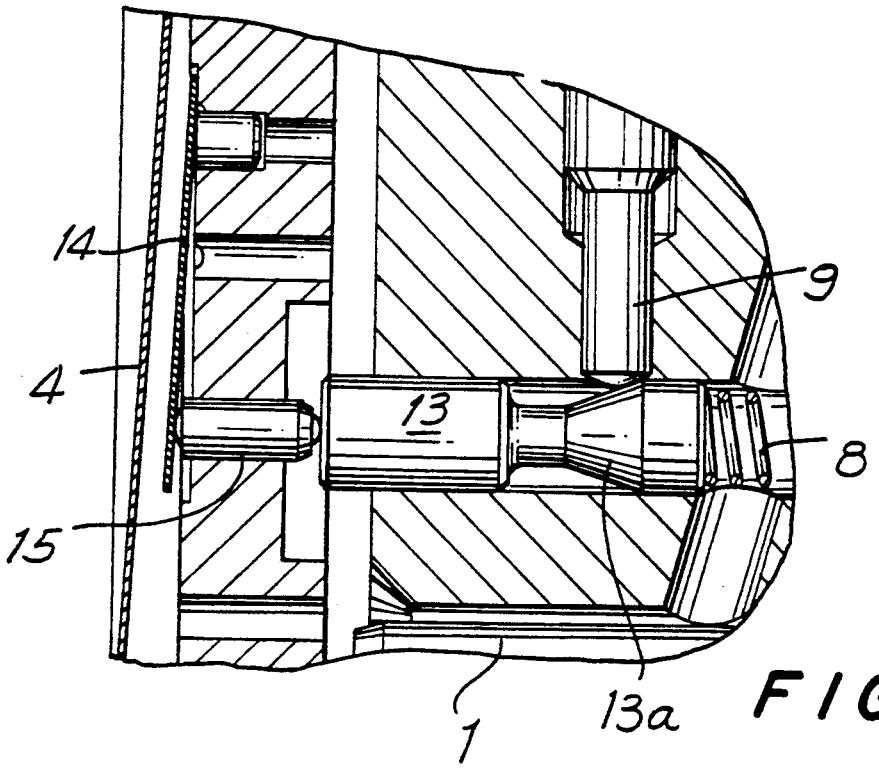
FIGS. 4A and 4B are views schematically showing two different positions of a membrane of the inventive piston membrane pump.
Figure 4B:
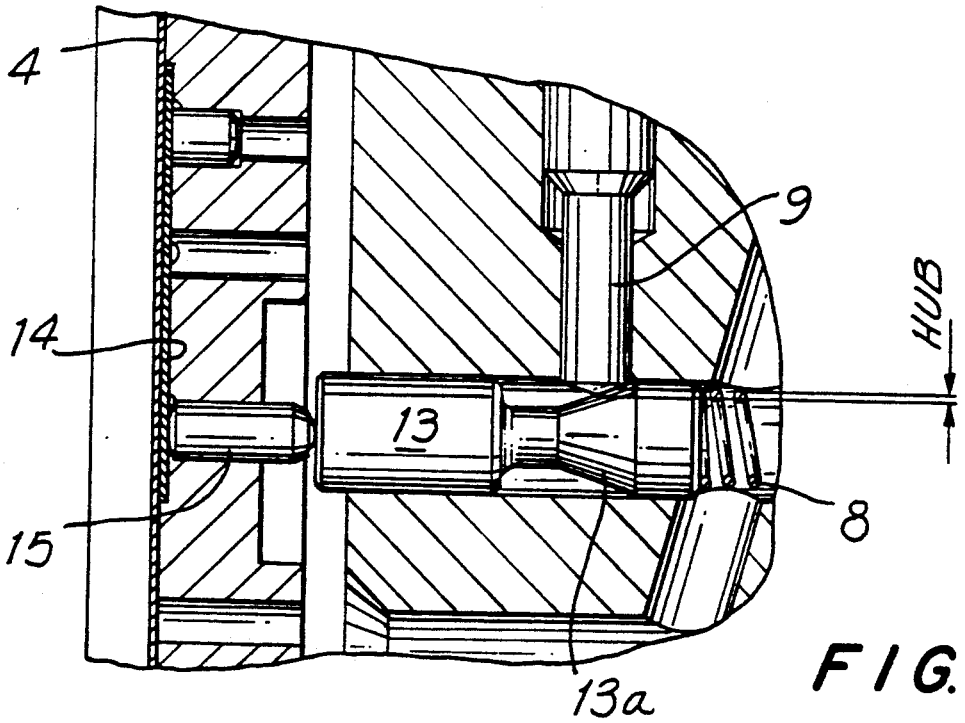

The piston membrane pump shown in FIG. 1 has a piston 1, which moves back and forth, i.e. oscillates, in a piston working chamber completely filled with hydraulic medium. Because of that the steel membrane 4 located between the feed chamber 3 and the piston working chamber 2 performs a membrane displacement according to the piston displacement volume.

During the low-pressure stroke fluid to be fed flows through the low-pressure-side valve 5 into the feed chamber and during the high-pressure stroke is pushed out through the high-pressure-side valve 6.

A rigid perforated supporting plate 7 is located in the piston working chamber.

A sliding control element 13 penetrates the supporting plate 7 through a through-going opening 20 in its peripheral region. This sliding control element 13 is provided with a conical peripherally recessed surface 13*a*. The sliding control element 13 stands under pressure from a control spring 8 acting in the direction of the supporting plate 7.

In the vicinity of the conical surface 13*a* of sliding control element 13 an actuator rod 9 engages with one of its ends the control element 13 substantially perpendicularly. The actuator rod 9 stands with its other opposite end against the closing member 10 of a refill valve 12. The length of the actuator rod 9 is so selected and dimensioned that when the actuator rod 9 is in its outer extreme position on the conical peripherally recessed surface 13*a* of the sliding control element 13 the valve 12 is held in its closed configuration so that no hydraulic medium can flow into the piston working chamber from the supply container 11. This is the standard configuration of the arrangement.

When, after a certain operating time because of the unavoidable loss of hydraulic medium, the extreme inward displacement of the membrane slowly walks inwardly into the piston working chamber, the membrane 4 reaches the leaf spring 14 and it pushes against the spring-loaded sliding control element 13 in the direction of the piston working chamber. The sliding control element 13 contacting on the leaf spring 14 moves itself positively against the force of the control spring 8 in the same direction, so that the actuator rod 9 slides on the conical peripherally recessed surface 13*a* in the sliding control element 13. Thus the closing member 10 of the refill valve 12 is moved to a valve-opening position. The refill valve 12 opens because of the reduced pressure in the piston working chamber and allows hydraulic medium to flow into the piston working chamber from the supply container 11. Thus the membrane 4 and the leaf spring 14 again move in the direction of the feed chamber 3. The sliding control element 13 is held by the pressure of the control spring 8 engaged with the leaf spring 14 and performs the same motion accordingly. During this motion the actuator rod slides upwards along the conical peripherally recessed surface 31*a* until it again abuts in its outer extreme position adjacent the outer circumference of the sliding control element 13. Thus the closing member 10 is held shut in the closed position of the refill valve 12.

The leaf spring 14 is mounted in a recess 21 of the support plate 7 and is attached to it by a weld point 16, Since the attachment point is located further exteriorly peripherally than the axis or center of the sliding control element the leaf spring automatically fits itself to the curvature of the metal membrane.

The control element 13 which is in the form of a control rod has a reduced diameter on its end 13*b* which projects through the supporting plate 7 so that on contact with the membrane 4 the leaf spring 14 can not punch into the supporting plate through-going opening 20. To make assembly easier the end region 13*b* of the control rod can be formed with a decreasing diameter and as a separate pin. Because of the clamping of the sliding control element and, if necessary, the separate pin between the leaf spring 14 and the spring 8, contact between the parts is determined according to the forces acting on them.

The valve spring in the refill valve 12 shown in the drawing but unlabelled only prevents the fall of the closing member 10, without however exerting a closing force on the valve.

In FIG. 2 a view of the leaf spring 14 is presented which shows that it has an oval form. The leaf spring 14 completely covers the supporting plate opening 20 for the sliding control element shown with dashed lines in the figure.

In FIG. 3 an alternative embodiment of the membrane pump with a different structure in the vicinity of the leaf spring is shown. The method of leaf spring attachment is different. The leaf spring 14 is detachably secured in this embodiment, not welded in place. On the leaf spring 14 a threaded rod is attached by welding. When it is inserted through a suitable through-going opening in the supporting plate, it is detachably secured by a nut 18 and a following lock nut 19 on the other side of the supporting plate 7.

A piston membrane pump is provided, which removes the disadvantages shown in an advantageous way.

It will be understood that each of the elements described above, or two or more together, may also find a useful application in other types of constructions differing from the types described above.

While the invention has been illustrated and embodied in a piston membrane pump with a freely oscillating metal membrane, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims.

1. In a piston membrane pump having a feed chamber and a piston working chamber, comprising a membrane hermetically separating said feed chamber and said piston working chamber, a piston oscillating back and forth in said piston working chamber, said piston working chamber being completely fillable with a hydraulic medium, a supply container for said hydraulic medium, a refill valve through which said piston working chamber is connected with said supply container, said refill valve having a sliding control element acted on by a control spring and a moving force-transmitting element, which is displaced against said sliding control element acted on by said control spring so as to open said refill valve, the improvement wherein the force-transmitting element comprises a resilient platelike piece opposing the action of the control spring of the sliding control element, the membrane has no contact surfaces on its feed chamber side in said feed chamber, a perforated supporting plate is fixedly arranged between said membrane and said piston.

2. The improvement according to claim 1, wherein said force-transmitting element comprises a secured leaf spring.

3. The improvement according to claim 2, wherein said leaf spring is secured in the vicinity of one end thereof.

4. The improvement according to claim 3, wherein said leaf spring is secured more exteriorly peripherally from said piston than said sliding control element.

5. The improvement according to claim 4, wherein said leaf spring is detachably secured.

6. The improvement according to claim 1, wherein said force-transmitting element has a curvature, which is adjusted to the curvature of said membrane.

7. The improvement according to claim 1, wherein said force-transmitting element has a spring force, which is adjusted to that of the opposing control spring of the sliding control element in such a way that the refill valve opens in response to a pressure differential of less than 0.2 bar.

8. The improvement according to claim 7, wherein said refill valve opens when said pressure differential is less than 0.10 bar.

9. The improvement according to claim 1, wherein said sliding control element engaging on said force-transmitting element has a rounded end.

10. The improvement according to claim 9, wherein said force-transmitting element completely covers said sliding control element.

11. The improvement according to claim 1, wherein said force-transmitting element is mounted flush in said perforated supporting plate.

12. The improvement according to claim 1, wherein said supporting plate is provide with a through-going opening for said control element having a diameter and the diameter of said through-going opening for said control element and said force-transmitting element are dimensioned so that a penetration of said leaf spring is avoided even at the highest supply pressure.

13. The improvement according to claim 1, further comprising an actuator rod and wherein said sliding control element comprises a control rod with a conical peripherally recessed surface, on which said actuator rod is mounted substantially perpendicular to said control rod.

14. The improvement according to claim 13, further comprising a perforated supporting plate located between said piston working chamber and said feed chamber and wherein said control rod has a tapered region penetrating said perforated supporting plate.

15. The improvement according to claim 14, wherein said tapered region of said control rod is provided on a pin separated from said control rod.

16. In a piston membrane pump having a feed chamber and a piston working chamber, comprising a membrane hermetically separating said feed chamber and said piston working chamber, a piston oscillating back and forth in said piston working chamber, said piston working chamber being completely fillable with a hydraulic medium, a supply container for said hydraulic medium, a refill valve through which said piston working chamber is connected with said supply container, said refill valve having a sliding control element acted on by a control spring and a moving force-transmitting element, which is displaced against said sliding control element acted on by said control spring so as to open said refill valve, the improvement wherein the membrane is made of metal, the force-transmitting element comprises a resilient platelike piece opposing the action of the control spring of the sliding control element, the membrane has no contact surfaces on its feed chamber side in said feed chamber, said force-transmitting element comprises a secured leaf spring.

17. The improvement according to claim 16, wherein said leaf spring is secured in the vicinity of one end thereof.

18. The improvement according to claim 17, wherein said leaf spring is secured more exteriorly peripherally from said piston than said sliding control element.

19. The improvement according to claim 18, wherein said leaf spring is detachably secured.

20. In a piston membrane pump having a feed chamber and a piston working chamber, comprising a membrane hermetically separating said feed chamber and said piston working chamber, a piston oscillating back and forth in said piston working chamber, said piston working chamber being completely fillable with a hydraulic medium, a supply container for said hydraulic medium, a refill valve through which said piston working chamber is connected with said supply container, a sliding control element acted on by a control spring and a moving force-transmitting element, which is displaced against said sliding control element acted on by said control spring so as to open said refill valve, the improvement wherein the membrane is made of metal, the force-transmitting element comprises a resilient plate-like piece opposing the action of the control spring of the sliding control element, the membrane has no contact surfaces on its feed chamber side in said feed chamber, and a perforated supporting plate between said membrane and said piston, said force-transmitting element is mounted flush in said perforated supporting plate.

21. In a piston membrane pump having a feed chamber and a piston working chamber, comprising a membrane hermetically separating said feed chamber and said piston working chamber, a piston oscillating back and forth in said piston working chamber, said piston working chamber being completely fillable with a hydraulic medium, a supply container for said hydraulic medium, a refill valve through which said piston working chamber is connected with said supply container, a sliding control element acted on by a control spring and a moving force-transmitting element, which is displaced against said sliding control element acted on by said control spring so as to open said refill valve, the improvement wherein the membrane is made of metal, the force-transmitting element comprises a resilient plate-like piece opposing the action of the control spring of the sliding control element, the membrane has no contact surfaces on its feed chamber side in said feed chamber, an actuator rod is provided, said sliding control element comprises a control rod with a conically peripherally recessed surfaces on which said actuator rod is mounted substantially perpendicular to said control rod, a perforated plate is located between said piston working chamber and said feed chamber and said control rod has a tapered region penetrating said perforated supporting plate and provided on a pin separated from said control rod.

* * * * *